US007380692B2

(12) United States Patent
Kostal et al.

(10) Patent No.: US 7,380,692 B2
(45) Date of Patent: Jun. 3, 2008

(54) BELT ATTACHMENT

(76) Inventors: Bretislav Kostal, Zelivecka 12, 1500 Prague 10 (CZ); Vladimir Kupa, Frant. Sramka 15, 1500 Prague 5 (CZ)

( * ) Notice: Subject to any disclaimer, the term of this patent is extended or adjusted under 35 U.S.C. 154(b) by 579 days.

(21) Appl. No.: 10/795,487

(22) Filed: Mar. 8, 2004

(65) Prior Publication Data

US 2004/0178241 A1 Sep. 16, 2004

(30) Foreign Application Priority Data

Mar. 12, 2003 (CZ) ..... 2003-728

(51) Int. Cl.
*A45F 5/00* (2006.01)

(52) U.S. Cl. ..... 224/666; 224/269; 24/528

(58) Field of Classification Search ..... 224/195, 224/197, 660, 665, 666, 678, 269, 272, 914; 248/229.12, 229.22, 228.3, 230.3, 231.41; 24/527, 528, 182, 3.1

See application file for complete search history.

(56) References Cited

U.S. PATENT DOCUMENTS

| | | | | | |
|---|---|---|---|---|---|
| 573,685 | A * | 12/1896 | Munro | 24/528 |
| 1,760,346 | A * | 5/1930 | Correa | 24/72.5 |
| 2,931,085 | A * | 4/1960 | Benlian | 24/370 |
| 4,662,552 | A | 5/1987 | Uyehara | |
| 5,383,793 | A * | 1/1995 | Hsu et al. | 439/327 |
| 5,457,745 | A * | 10/1995 | Wang | 379/454 |
| 5,593,074 | A * | 1/1997 | Matthews | 224/251 |
| 5,685,732 | A * | 11/1997 | Lane | 439/369 |
| 5,730,348 | A | 3/1998 | Tien | |
| 5,836,563 | A * | 11/1998 | Hsin-Yung | 248/316.4 |
| 5,875,944 | A | 3/1999 | Beletsky | |
| 5,893,630 | A | 4/1999 | Mosquera | |
| 6,059,157 | A | 5/2000 | Parsons et al. | |
| 6,290,112 | B1 * | 9/2001 | Iver | 224/271 |
| 6,471,171 | B1 * | 10/2002 | VanderVelde | 248/229.12 |
| 6,614,908 | B1 * | 9/2003 | Huang | 379/446 |
| 6,647,248 | B1 * | 11/2003 | Ortscheid et al. | 224/255 |
| 6,889,878 | B2 * | 5/2005 | Parsons | 224/200 |
| 2004/0051015 | A1 * | 3/2004 | Ohrling | 248/214 |

FOREIGN PATENT DOCUMENTS

| | | |
|---|---|---|
| DE | 199 02 682 A | 7/2000 |
| FR | 2 840 168 | 12/2003 |

* cited by examiner

*Primary Examiner*—Nathan J. Newhouse
*Assistant Examiner*—Justin M Larson
(74) *Attorney, Agent, or Firm*—Collard & Roe, P.C.

(57) ABSTRACT

A belt attachment with fastening clips (12, 32) adjustable to an opened and closed position comprises an upper clip (12) connected with a bush (1) and a lower clip connected with slides (23) through which the lower clip is mounted for longitudinal motion in the bush (1) along its longitudinal axis, whereby the position of the lower clip (32) with respect to the upper clip (12) in the closed position and at least in one opened position is fixed by a securing member (4). The bush (1) includes a bottom (11) and side walls (10) with grooves (13) for receiving slides (23) and an upper cross wall (19) forming a bending (121) of the upper clip (12).

7 Claims, 2 Drawing Sheets

BELT ATTACHMENT

The invention relates to a belt attachment with fastening clips adjustable into an opened and closed position. The belt attachment is designed as a means for attaching various items such as a baton holder gun etc. to the belt of the item's user, for example a law enforcement personnel, fire brigades etc.

DESCRIPTION OF THE PRIOR ART

One of the possible embodiments of the belt attachment associated with a police baton holder is described in U.S. Pat. No. 4,662,552. The attachment is a part of a holder of a baton to be attached to the belt. The holder carries a basic support, in which four slots symmetrically arranged are located. Two lengths of webbing provided by VELCRO fastener materials are treaded through the slots to firmly fix the support to the belt. Nevertheless, the VELCRO joint cannot prevent the attachment against an unauthorized release, for example when an officer is in a close contact with a suspect. To ensure a firm attachment to the belt the support shall have sufficient length, what on the other hand may restrict the persons bearing the belt from free movement in certain positions.

Similar type of a belt attachment is disclosed in U.S. Pat. No. 5,893,630, where instead of two webbing a belt loop is used. The loop wraps downwardly around the officer's belt to allow snaps on the lower portions of the belt loop to be snapped. Like the VELCRO joint the snaps do not provide a firm and uneasy releasable connection. Moreover, the length of the loop engaging the belt cannot be adapted to the belt size.

A belt attachment according to U.S. Pat. No. 6,059,157 constitutes an integral part of the back cover of a baton holder and includes a loop to be suspended from the belt. The end of the loop is secured to the holder by screws, which tighten down the loop against the belt. Like in the previous case the loop cannot be adapted to the belt size, specifically to its width and the mounting thereof on and dismantling from the belt requires the application of special instruments and screws that must be stored for further use. The belt attachment is designed for a specific item—a baton holder and can be hardly used in connection with another item.

SUMMARY OF THE INVENTION

The principal object of the invention is to provide a belt attachment that may be adjusted with respect to the belt width and quickly and safely fixed to the belt to carry a variety of items that may be easily connected to the belt attachment.

According to the invention a belt attachment with fastening clips adjustable to an opened and closed configuration comprises an upper clip connected with a bush and a lower clip connected with in insert mounted for longitudinal motion in the bush along its longitudinal axis, whereby the position of the lower clip with respect to the upper clip in the closed position and at least in one opened position is fixed by a securing member. Said features of the belt attachment provide for quick and safe fastening to and releasing from the elected item to any user's belt and to this effect the belt attachment may be adapted to the belt size.

In one specific embodiment of the belt attachment the insert (2) includes slides (23) and on the insert (2) a base (31) of the lower clip (3) is releasably mounted whereby the position of the lower clip with respect to the insert is adjustable along the longitudinal axis of the insert and the bush. The bush may include a bottom and side walls with grooves for receiving slides and an upper cross wall forming a lip of the upper clip. The insert may further consist of two elongated L-shaped profiles joined together by a central plate defining an upper and lower portion of the insert whereby the upper portion defines the space for the lower clip and the lower portion between the slides defines the space for the securing member.

Accordingly, the belt attachment thus includes two principal parts movable with respect to each other and which may be easily moved to a closed or opened position. The both positions of the belt attachment are secured by one securing member.

The securing member my consist of two resilient arms provided by catches at their free ends. The arms are linked together by a cross beam and the slides have two opposite situated recesses and the side walls of the bush two opposite situated upper apertures and two opposite situated lower apertures for receiving the catches.

To adapt the belt attachment to the belt size the L-profiles are in the upper portion of the insert provided by an internal tooth system and the base of the lower clip is on its opposite outer walls provided by a complementary external tooth system. The plate has an elongated cut-out situated along the central axis of the insert and the lower clip has an opening the axis of which intersects the axis of the cut-out.

To enable an easy operation of the belt attachment the insert is provided on its lower side by a holder extending above the upper surface of the plate and the cross beam of the securing member is provided by a grip extending above the lower surface of the arms and the outer side walls of the bush have recesses in the area of the upper apertures.

In order to ensure a safe checking of the closed position of the belt attachment the plate of the insert has on its upper side wall a projection and the cross wall of the bush has a hole for receiving the projection, when the belt attachment is in its closed position.

To enable the connection of a variety of items to the belt attachment the bottom of the bush has an opening and. on the outer back surface of the bottom a concentric tooth system is provided around the. axis of the opening.

Other principal features and advantages of the invention will become apparent to those skilled in the art upon review of the following drawings the detailed description and the appended claims.

DESCRIPTION OF THE PREFERRED EMBODIMENT

Figure 1A:
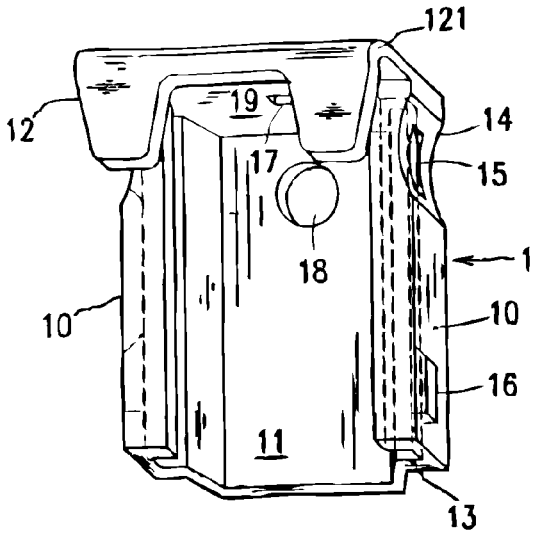
FIG. 1A—is a front perspective view of a bush as one part of the belt attachment.
Figure 1B:
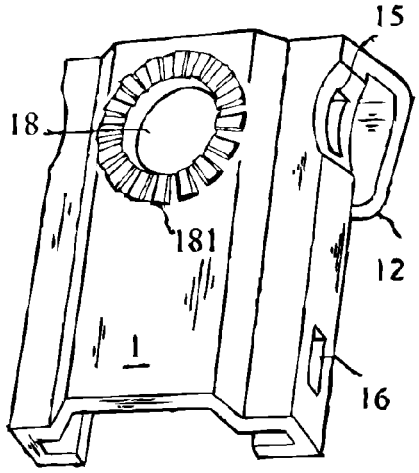
FIG. 1B—is a side perspective view of the opposite side of the bush shown in FIG. 1A.
Figure 6:
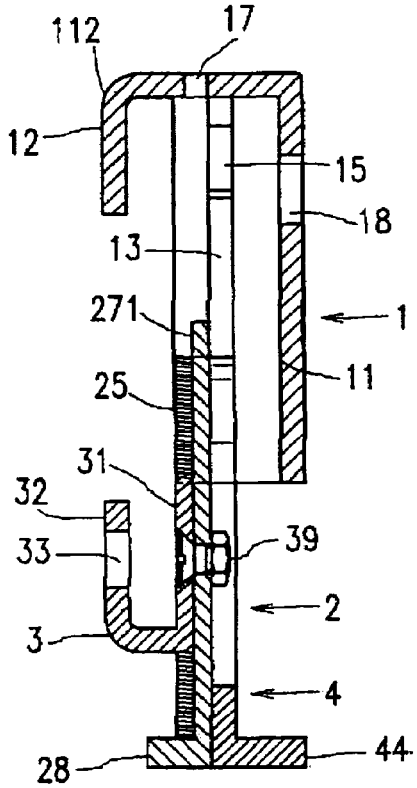
FIG. 6—is a sectional side view of an assembled belt attachment in an opened configuration.

A belt attachment of the invention consists of an upper clip 12 connected to a bush 1 and an lower clip 3 mounted on the insert 2 provided with slides 23 for insertion in the bush 1 and further of a securing member 4. The bush 1 (FIG. 1A; FIG. 6) has a U-shaped profile with partially inclined side walls 10 and a bottom 11. At its upper end the bush is closed by a cross wall 19 forming a lip 121 of the upper clip 12, which is designed to be suspended from a belt (not shown in the drawings) carried by a person using the belt. The inner surfaces of each side wall 10 of the bush 1 are formed into a groove 13 of approximately oblong cross profile. In the bottom wall of each groove 13 elongated apertures 15 and 16 are disposed symmetrically of the bush 1 central longitudinal axis. At the orifice of each upper aperture 15 the surface of the outer side wall 10 is provided with an annular recess 14. In the upper portion of the bottom 11 a circular opening 18 and in the cross wall 19 an oblong shaped hole 17 is located.

Figure 2:
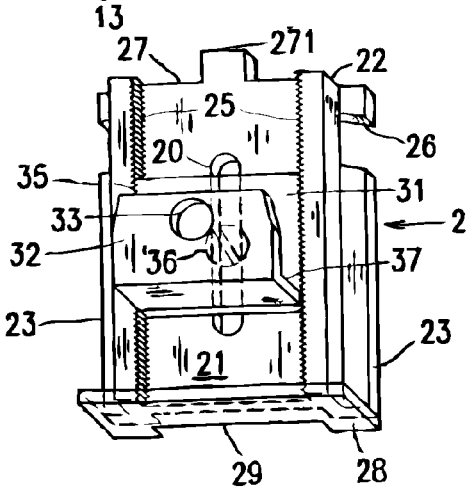
FIG. 2—is a front perspective view of an insert as another part of the belt attachment.

The insert 2 (FIG. 2, FIG. 6) comprises two elongated parallel L-shaped profiles 22 joined together by a plate 21. The lower portions of the L-shaped profiles 22 represent slides 23 that fit in the grooves 13 of the bush 1 for longitudinal motion. The outer distance between the upper portions of the profiles 22 above the plate 21 is determined to enable their free movement between the side walls 10 of the bush 1. The inner surfaces of the upper portions of the profiles 22 include tooth system 25. In the upper section of the slides 23 two opposite situated recesses 26 for a securing member 4 are provided. The upper edge 27 of the plate 21 includes a projection 271 and the lower side of the plate 21 includes a holder 28 with a recess 29. Along the central axis of the plate 21 there is an elongated cut-out 20. The lower clip 3 consists of a base 31 with a cross wall 37 and a lip 32. Either of the opposite lateral sides of the base 31 includes the tooth system 35 that is sized to fit in the tooth system 25 at any place between the profiles 22 of the insert 2. The base 32 has an opening 36 and the lip 32 another coaxial opening 33 both situated in the manner that their common axis intersects the axis of the elongated cut-out 20 in the plate 21. The base 31 is connected to the plate 21 by a bolt joint 39.

Figure 3:
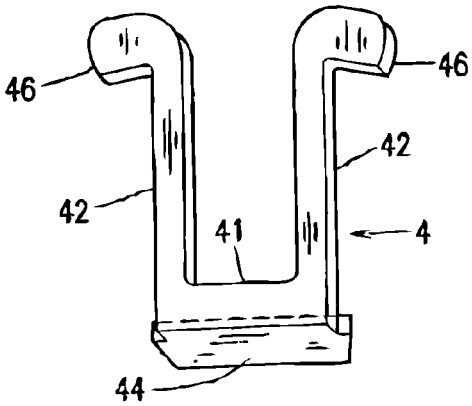
FIG. 3—is a front perspective view of a securing member.

The securing member 4 (FIG. 3; FIG. 6) includes a cross beam 41 and two upwardly extending resilient arms 42 provided by outwardly projecting catches (46) with rounded edges at their free ends 46. The cross beam 41 includes a grip (44) extending above the lower surface of the arms (42).

Figure 4:
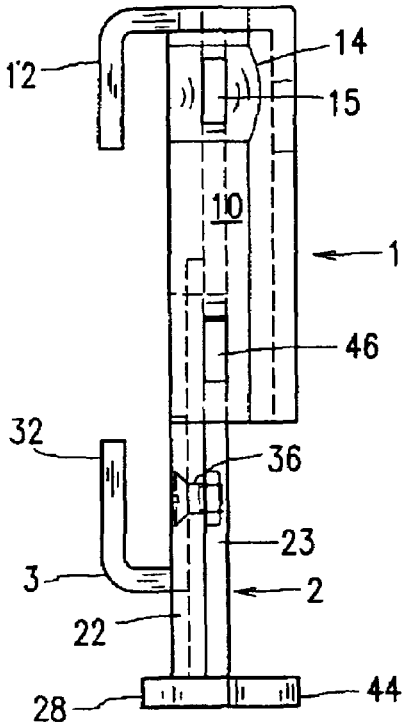
FIG. 4—is a side view of an assembled belt attachment in opened configuration.
Figure 5:
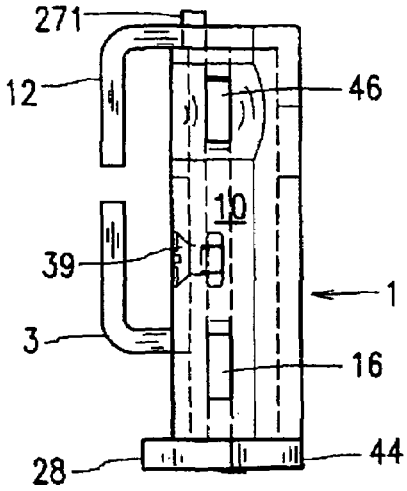
FIG. 5—is a side view of an assembled belt attachment in closed configuration.

In assembling the belt attachment, first the securing member is placed into the recess 29 of the insert 2 so that the catches 46 engage the recesses 26 in the slides 23 and the arms 22 seat against the back side of the insert 2 (FIG. 4; FIG. 6). Thereafter, the slides 23 are put in the grooves of the bush 1 to enable the upper edge 27 of the plate 21 to seat against the inner surface of the cross wall 19 of the upper clip 12 and at the same time the projection 271 engages the hole 17 so that the upper edge of the projection 271 extends over the outside surface of the cross wall 19 of the upper clip 12 (FIG. 5). In this configuration the catches 46 fit in the apertures 15 of the bush 1 to ensure the locking of the insert 2 in the bush 1. In the course of insertion of the insert 2 into the bush 1 the catches 46 are retained in the lower apertures 16, nevertheless due to the rounded ends of the catches 46 the insert 2 is not firmly locked in the bush 1 and the insert 2 may be further pushed upwardly to engage the cross wall 19 of the upper clip 12. Thereafter the bush 1 may be suspended by means of the upper clip 12 from the belt and the base 31 placed on the plate 21 of the insert 2 so that the tooth system 35 of the base 3 fit in the tooth system 25 of the insert 2 and the lower clip 3 together with the upper clip 12 hold firmly on the belt. Thus the belt attachment is adapted to a specific belt size. The base 32 is then fixed to the plate 21 by means of a bolt joint 36 through the cut-out 20. At this point the assembly of the belt attachment is finished.

The fastening of the belt attachment to the belt proceeds in such a manner that the bush 1 is first suspended by means of the upper clip 12 from the belt and by pushing the holder 28 upwardly the insert 2 is moved inside the bush 1. In this operation it is to care that the lip 32 of the lower clip 32 overlaps the belt. When the belt is gripped between the upper and lower clips the catches 46 fit in the apertures 15 of the bush 1 and the insert is immovably locked in the bush 1 and the belt attachment holds firmly on the belt. The safety of the closed position may be easily checked. by viewing or touching the extending catches 46 in the recesses 14 or still more easily by monitoring the projection 271 that shall protrude from the hole 17. This projection is designed to enable easy monitoring of the closed position.

In releasing the belt attachment from the belt first the catches 46 of the resilient arms 42 are to be pushed inwardly by fingers and by pulling the holder 28 downwardly the insert 2 is shifted to the position, where the catches 46 fit in the lower apertures 16 of the bush 1 so that the belt attachment takes its opened position and it may be removed from the belt. The described design enables the belt attachment to be fastened to and released from the belt by one hand only.

Figure 7:
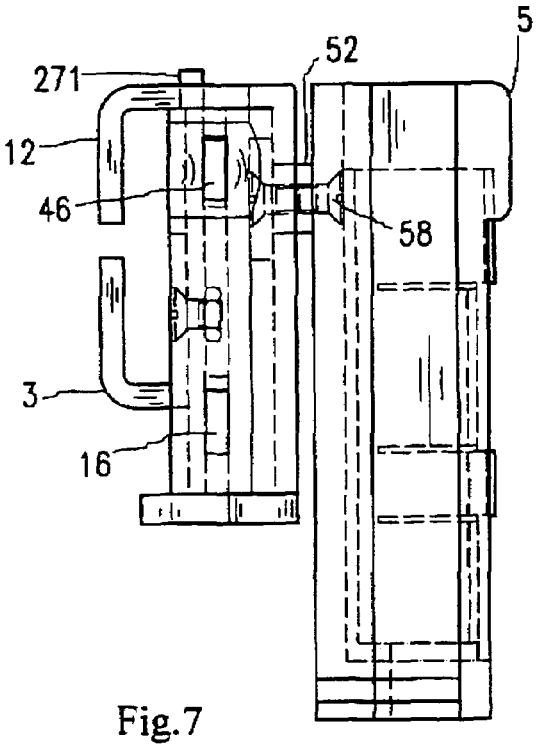
FIG. 7—is a side view of a belt attachment in connection with a baton holder.

FIG. 7 shows an embodiment, where the belt attachment is connected to a baton holder 5 by means of a bolt joint 58 passing through the opening 18 in the bottom 11 of the bush 1. The bottom 11 of the bush 1 and the adjacent wall of the baton holder are separated by a washer 58. The bolt joint 58 enables the baton holder to turn on the bolt joint axis and so to elect the most convenient position of the baton holder with respect to the belt attachment and relative to the belt. The baton holder may be safely stabilized in the elected position by means of a radial tooth system 181 provided on the washer faces and by a complementary tooth system on the back side of the bush 1 and the adjacent wall of the baton holder.

INDUSTRIAL APPLICABILITY

The belt attachment according to the invention may be used for connection of various equipment to the belt such as batons, defensive and offensive weapons etc. used for example by law enforcement forces, fire brigades or army. The belt attachment may also be used in performing other professional or leisure activities for example high rise buildings works, climbing etc.

The invention claimed is:

1. A belt attachment for carrying objects having belt fastening clips adjustable to closing and opening positions with respect to belt comprising:

a bush having a bottom, a set of side walls and an upper cross wall having a hole and an upper clip incorporated in said upper cross wall;

an insert mounted for slidable motion in said bush along its longitudinal axis, said insert including a central plate with a projection on its upper side to protrude through said hole when the attachment is in its closed position, and further including a front side having a lower clip fixed thereto and a back side having lateral slides disposed along the longitudinal axis of the insert for sliding in said side walls of the bush;

a securing member engaging said insert for holding said insert in said bush in a closed position and in at least one opened position; and a fastener which fastens objects to said bush.

2. A belt attachment for carrying objects having belt fastening clips adjustable to closing and opening positions with respect to belt comprising:

a bush having a bottom including an opening and a concentric tooth system provided around the axis of the opening on the outer back surface of the bottom for fastening objects, the bush including a set of side walls and an upper cross wall;

an upper clip incorporated in said upper cross wall of the bush;

an insert mounted for slidable motion in the bush along its longitudinal axis;

a lower clip with a base coupled to the insert;

a securing member engaging said insert for holding said insert in said bush in a closed position and in at least one opened position;

a fastener which fastens objects to the bush.

3. A belt attachment for carrying objects having belt fastening clips adjustable to closing and opening positions with respect to belt comprising:

a bush having a set of bottom side walls and an upper cross wall;

an upper clip incorporated in said upper cross wall of the bush;

an insert mounted for slidable motion in the bush along its longitudinal axis;

a lower clip with a base for affixing to the insert, and a fastener adjustable along the longitudinal axis of the insert and the bush, which adjusts and secures the base with respect to the insert, wherein said adjustable fastener is a bolt joint;

a securing member engaging the insert for locking the insert in the bush in one stable closed position and in at least one opened position;

a fastener which fastens objects to the bush.

4. A belt attachment for carrying objects having belt fastening clips adjustable to closing and opening positions with respect to belt comprising:

a bush having a bottom, and an upper cross wall and a set of side walls having longitudinal grooves on their inner surfaces, the side walls having two opposite situated upper apertures and at least two opposite situated lower apertures passing outwardly from the grooves;

an upper clip incorporated in said upper cross wall of said bush as a lip extending downwardly from said upper cross wall;

an insert including a central plate having a front side and a back side to face the bottom of said bush and having lateral slides disposed along the longitudinal axis of the insert for engaging said longitudinal grooves of said bush to enable a slidable mounting of said insert in said bush said lateral slides having two opposite situated recesses facing said apertures in the closing and the opening positions of the attachment;

a lower clip having a base and an adjustable fastener for affixing it to the front side of said insert;

a securing member engaging said back side of said central plate for holding said insert in said bush in a closed position and in at least one opened position said securing member having two resilient arms linked together by a cross beam and including catches at their free ends extending through said recesses for engagement with said apertures to fix said insert in said bush in a closed position and in at least one opened position of the attachment; and a fastener for fastening objects to the bush.

5. A belt attachment of claim 4, wherein the central plate has an elongated cut-out for receiving said adjustable fastener for affixing the lower clip to the insert along its longitudinal axis.

6. A belt attachment of claim 4, wherein said cross beam of said securing member comprises a grip.

7. A belt attachment of claim 4, wherein said side walls have recesses disposed on the outer surface of said side walls of said bush, in a region adjacent to said upper apertures.

* * * * *